US010729172B2

(12) United States Patent
Kümpel et al.

(10) Patent No.: US 10,729,172 B2
(45) Date of Patent: Aug. 4, 2020

(54) PRODUCT FOR HOLDING A TOBACCO PRODUCT OR A TOBACCO SUBSTITUTE WITH INTEGRATED ELECTRONIC DEVICE

(71) Applicant: JT International S.A., Geneva (CH)

(72) Inventors: Jürgen Kümpel, Konz (DE); Olaf Janson, Steinhagen (DE)

(73) Assignee: JT International S.A. (CH)

( * ) Notice: Subject to any disclaimer, the term of this patent is extended or adjusted under 35 U.S.C. 154(b) by 0 days.

(21) Appl. No.: 16/075,038

(22) PCT Filed: Feb. 24, 2017

(86) PCT No.: PCT/EP2017/054388
§ 371 (c)(1),
(2) Date: Aug. 2, 2018

(87) PCT Pub. No.: WO2017/148829
PCT Pub. Date: Sep. 8, 2017

(65) Prior Publication Data

US 2019/0037916 A1 Feb. 7, 2019

(30) Foreign Application Priority Data

Mar. 2, 2016 (WO) ..... PCT/EP2016/054385

(51) Int. Cl.
*A24F 15/08* (2006.01)
*A24F 15/00* (2020.01)
*A24F 47/00* (2020.01)

(52) U.S. Cl.
CPC ..... *A24F 15/08* (2013.01); *A24F 15/00* (2013.01); *A24F 47/008* (2013.01)

(58) Field of Classification Search
None
See application file for complete search history.

(56) References Cited

U.S. PATENT DOCUMENTS

2015/0016048 A1* 1/2015 Chang ..... H03K 5/05 361/679.32
2015/0077981 A1 3/2015 Cormack
(Continued)

FOREIGN PATENT DOCUMENTS

EP 2959784 A1 12/2015

OTHER PUBLICATIONS

International Search Report for PCT/EP2017/054388 dated May 4, 2017.

(Continued)

*Primary Examiner* — Mukundbhai G Patel
(74) *Attorney, Agent, or Firm* — Lerner, David, Littenberg, Krumholz & Mentlik, LLP

(57) ABSTRACT

A product for holding a tobacco product or a tobacco substitute includes an integrated electronic device with: a power source; an input means comprising a sensor to generate an input signal from an external stimulus; an output means to generate an output signal; digital processing means to process the input signal and deliver a command signal to the output means based at least in part on processing of the input signal; and circuitry connecting the power source, the input means, the output means and the digital processing means; wherein the power source, the input means, the output means, the digital processing means and the circuitry are printed on a substantially flexible substrate. Use of packaging for holding a tobacco product or tobacco substitute includes such a product with an integrated electronic device.

14 Claims, 4 Drawing Sheets

(56) References Cited

U.S. PATENT DOCUMENTS

| | | | | |
|---|---|---|---|---|
| 2015/0082859 | A1 | 3/2015 | Xiang | |
| 2017/0038325 | A1* | 2/2017 | Takashima | G06K 19/0717 |
| 2017/0197777 | A1* | 7/2017 | Slooff | B65D 79/02 |

OTHER PUBLICATIONS

International Search Report including Written Opinion for PCT/EP2016/054385 dated Oct. 31, 2016.

* cited by examiner

PRODUCT FOR HOLDING A TOBACCO PRODUCT OR A TOBACCO SUBSTITUTE WITH INTEGRATED ELECTRONIC DEVICE

CROSS-REFERENCE TO RELATED APPLICATIONS

The present application is a national phase entry under 35 U.S.C. § 371 of International Application No. PCT/EP2017/054388, filed Feb. 24, 2017, published in English, which claims priority to International Application No. PCT/EP2016/054385 filed Mar. 2, 2016, the disclosures of which are incorporated herein by reference.

FIELD OF THE INVENTION

The present invention relates to a product for holding a tobacco product or a tobacco substitute with an integrated electronic device.

BACKGROUND OF THE INVENTION

Packages for storing products are well known in the art. Such packages may take many different forms, but typically involve the bending or folding, or both, of flexible materials, such as cardboard, to form the package from one or more sheets of material. It is also known to incorporate electronic circuits, typically formed by connecting pre-manufactured discrete components such as a battery, CPU, memory, sensor and display together in a circuit, into such packages. Such packages may be referred to as hybrid packages (or containers).

One example of the use of electronic circuits in hybrid packaging is to embed a sensor which can sense a package's environment. Another example of a hybrid package is a facial tissue container which has an internal light source which incorporates a printed circuit board connected to multiple LEDs, a switch and a power supply which can emit light under various conditions. A further example of a hybrid package is a package for a CD which comprises organic light emitting devices (OLEDs) and a battery to provide an alphanumeric display on the package which may be used to convey information.

However, one of the problems associated with known hybrid packages is that the processes of designing, manufacturing and assembling the packaging, as well as the subsequent use of the package, are all negatively impacted by the inclusion of such electronic circuits. This is because the discrete components of the electronic circuit, such as the battery, which are typically bulky and heavy, need to be housed inside the package in such a manner that they are well supported and protected. Therefore, hybrid package designers typically have to design a compartment in the package in which the components of the electronic circuit may reside. This complicates the design process and imposes limitations on the design of the package. Additionally, the manufacture of hybrid packages is typically more complex and expensive because, not only does an additional compartment in the package need to be assembled, but the discrete electronic components also need to be connected together to form the electronic circuit and then carefully positioned and secured to the package. Furthermore, the presence of the components and the compartment introduces additional bulk and weight to the package, whilst reducing the valuable product storage space inside the package.

It is therefore desirable to provide an integrated electronic device which can be formed, in its entirety, integrally with a flexible material, which may then be bent, folded or otherwise formed into a package or indeed any other product or article into which it is desired to incorporate an electronic circuit.

SUMMARY OF THE INVENTION

The formation of hybrid packages which incorporate an electronic circuit as described above is a complex matter. Such hybrid packages require additional design effort and material to form a compartment in which the various discrete components of the electronic circuit should be placed. Furthermore, additional manufacturing steps are required to insert and connect the discrete components of the electronic circuit together and into the package. It is therefore desirable to provide an integrated electronic device which can be entirely formed by a printing process onto a substantially flexible substrate which may then be formed into a package without requiring any (or at least fewer) modifications to the package design or the manufacturing process. Such an integrated electronic device may also be readily incorporated into other items outside of the field of product packaging, where it is desirable to incorporate an electronic circuit into a product which is formed from material which may be folded or bent.

According to a first aspect of the invention, there is provided a product for holding a tobacco product or a tobacco substitute comprising an integrated electronic device with: a power source; an input means comprising a sensor to generate an input signal from an external stimulus; an output means to generate an output signal; digital processing means to process the input signal and deliver a command signal to the output means based at least in part on processing of the input signal; and circuitry connecting the power source, the input means, the output means and the digital processing means; wherein the power source, the input means, the output means, the digital processing means and the circuitry are printed on a substantially flexible substrate.

The digital processing means may comprise printed dopant poly-silicon transistors.

The digital processing means may comprise a memory.

Where the input means comprises a sensor, the input means may comprise at least one of a humidity sensor, a light sensor, a motion sensor, a temperature sensor and/or a gas sensor.

The sensor may be a resistive type sensor.

The input means may comprise a wireless signal receiver.

The output means may comprise at least one of a display, a lighting means, a sound generator and/or a wireless signal emitter.

The power source may comprise at least one of a battery, energy harvesting means or electromagnetic charging means.

The substrate may comprise synthetic and/or natural material in a sheet form.

The substrate may comprise a laminate.

The substrate may comprise folding and/or creasing lines.

The integrated electronic device may further comprise a protective layer covering all of the substrate, the power source, the output means, the digital processing means and the circuitry but the input means.

The integrated electronic device may further comprise a removable protective layer covering all of the substrate, the power source, the output means, the digital processing means and the circuitry and the input means.

According to a second aspect of the invention, there is provided the use of packaging for holding a tobacco product or a tobacco substitute comprising a product according to the first aspect.

BRIEF DESCRIPTION OF THE DRAWINGS

Embodiments of the invention will now be described, by way of example only, with reference to the accompanying drawings, in which.

DETAILED DESCRIPTION OF EMBODIMENTS OF THE INVENTION

In the description that follows and in the figures, certain embodiments of the invention are described. However, it will be appreciated that the invention is not limited to the embodiments that are described and that some embodiments may not include all of the features that are described below. It will be evident, however, that various modifications and changes may be made herein without departing from the broader spirit and scope of the invention as set forth in the appended claims.

Figure 1:
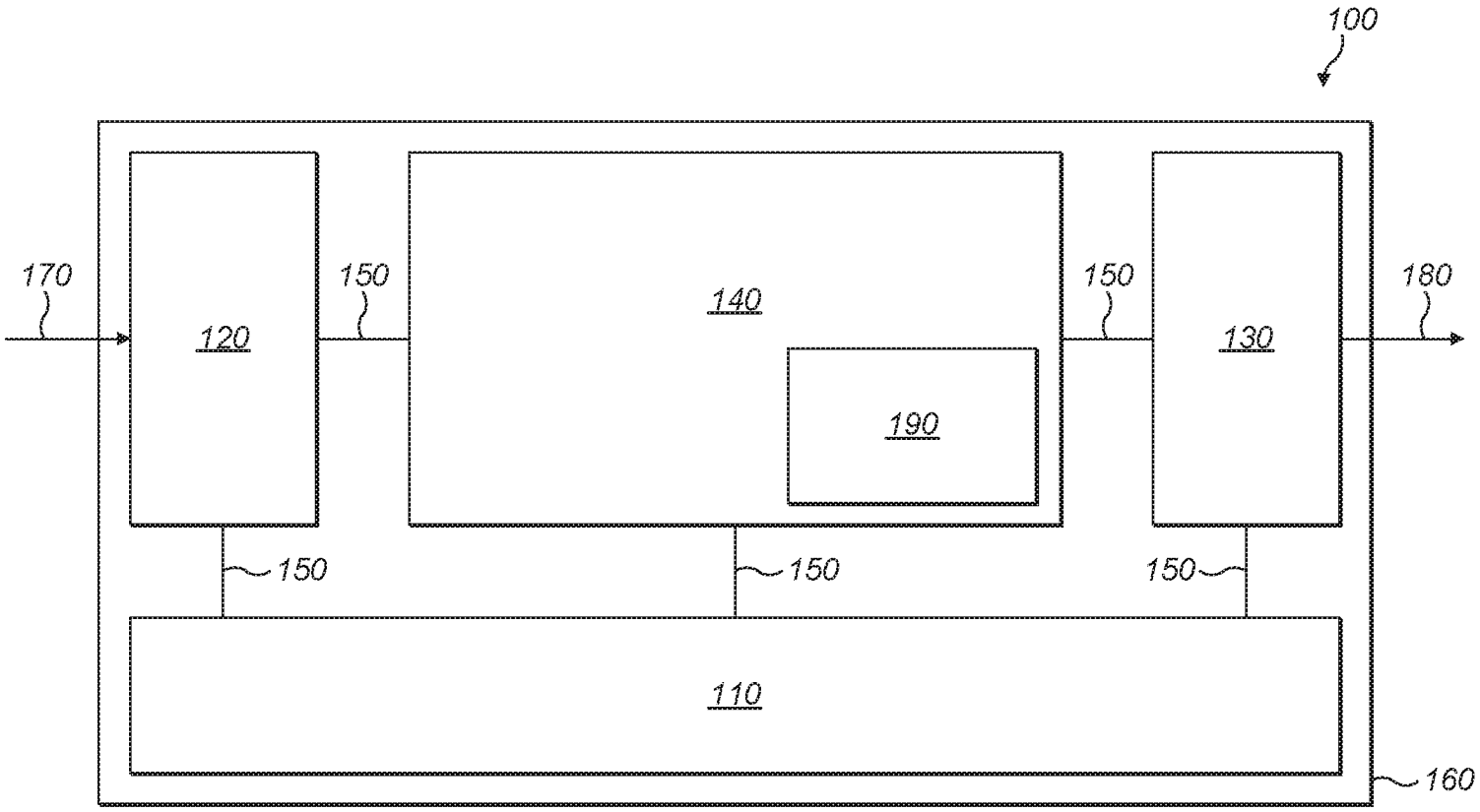
FIG. 1 schematically illustrates an integrated electronic device according to an embodiment of the invention.

FIG. 1 schematically illustrates an integrated electronic device 100 according to an embodiment of the invention. The integrated electronic device 100 comprises a power source 110, an input means 120, an output means 130, digital processing means 140 and circuitry 150. The circuitry 150 is arranged to connect the power source 110, the input means 120, the output means 130 and the digital processing means 140 together. Electrical power, or signals, or both, may be conveyed (or transferred) between the power source 110, the input means 120, the output means 130, the digital processing means 140 via the circuitry 150. The circuitry 150 may be formed by printing silver tracks on the substrate 160 connecting the components.

Figure 4:
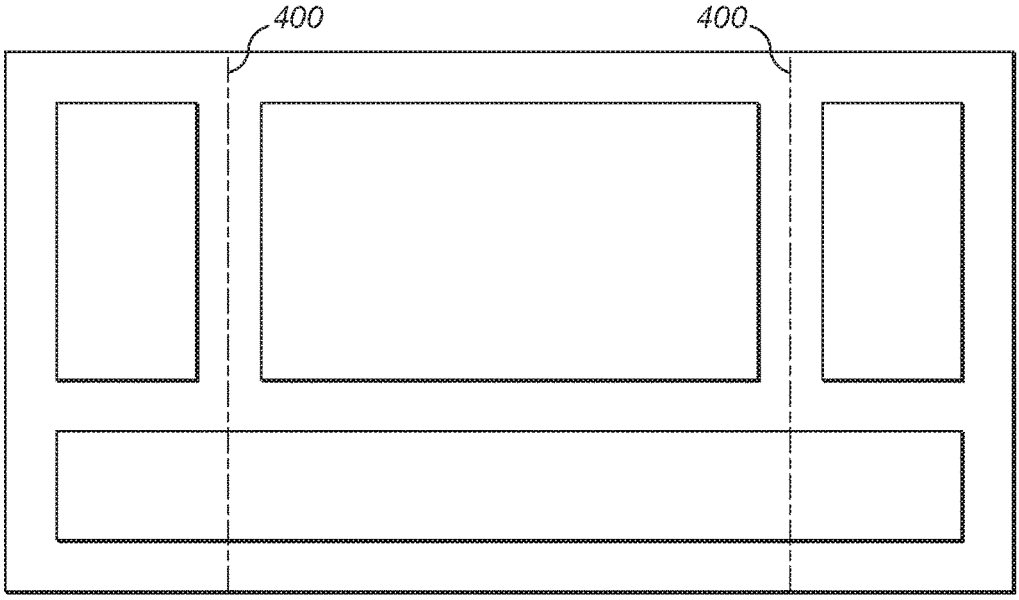
FIG. 4 schematically illustrates an alternative electronic device for use in a product for holding a tobacco material according to an embodiment of the invention.

The power source 110, the input means 120, the output means 130, the digital processing means 140 and the circuitry 150 are each formed by being printed on a substantially flexible substrate 160. That is to say, each of these components of the integrated electronic device 100 is formed as part of a printing process onto a surface (the substrate 160) which is substantially flexible. In other words, other than the depositing of material onto the substrate 160 (i.e. "printing"), there are no other steps (such as, for example, the attachment of discrete devices) which are necessary to produce the integrated electronic device 100. The substantially flexible substrate 160 is preferably flexible to the extent that it may be deformed to conform to the shape of another object (such as a package into which the integrated electronic device 100 is to be placed or built into as discussed further below). The substrate 160 may be comprised of synthetic material, or natural material, or both in a sheet form, preferably Polyethylene terephthalate or PET. The substrate 160 may comprise a laminate layered on top of another material. As shown in FIG. 4, the substrate 160 may comprise folding or creasing lines 400 or both to allow the integrated electronic device 100 to be folded to form a three-dimensional object (such as the packaging discussed below).

The power source 110 provides electrical power for the integrated electronic device 100. The power source 110 may comprise any one of the following: a battery; energy harvesting means; or electromagnetic charging means or any combination thereof. As an example, the integrated electronic device 100 may comprise a battery together with energy harvesting means and/or electromagnetic charging means, whereby the energy harvesting means and/or the electromagnetic charging means may act to charge the battery. In such an arrangement, energy gained via the energy harvesting means and/or the electromagnetic charging means which is surplus to the present requirements of the integrated electronic device 100 may be stored in the battery for later use. Preferably, the integrated electronic device 100 comprises at least a battery. However, it will be appreciated that this need not be the case.

The input means 120 are arranged to generate an input signal from an external stimulus 170. Preferably, the input means 120 comprises a sensor which is arranged to generate an input signal which is proportional to a sensed environmental parameter. Preferably, such a sensor comprises one or more of the following types of sensors: a humidity sensor; a light sensor; a motion sensor; a temperature sensor; and a gas sensor. It will, however, be appreciated that any other kind of sensor may be used as the input means 120. There are many different ways in which a sensor may operate to produce an input signal (the input signal being the output signal from the sensor) in response to an environmental parameter.

Other forms of input means 120 may be used instead of or in addition to a sensor. As an alternative, the input means 120 may comprise a wireless signal receiver which is arranged to generate an input signal based on a transmission received from a wireless signal transmitter. For example, a wireless signal transmitter may be arranged to transmit one or more measurements of sensed environmental parameters from one or more sensors that are local to the transmitter and the wireless signal receiver on the integrated electronic device 100 may produce an input signal which corresponds to the one or more measurements in response to receiving the transmitted signal. However, the transmitted signal may be any form of signal and need not necessarily correspond to a sensed environmental parameter.

The output means 130 are arranged to generate an output signal 180. Preferably the output means 130 comprises at least one of a display, a lighting means, a sound generator and/or a wireless signal emitter.

Where the output means 130 comprises a display, the display may be arranged to display one or more characters, numerals or symbols, or any combination thereof, or may be arranged to display a graphical output (which might include graphical representations of characters, numerals or symbols, or any combination thereof). Preferably the display is a printed electrochromic display.

Where the output means 130 comprises lighting means, the lighting means may be arranged to provide an output signal 180 through the brightness of the emitted light. As an example, the lighting means may emit light as a first output signal and no light as a second output signal. Alternatively or additionally, the lighting means may be arranged to provide an output signal 180 through a colour of the emitted light. As an example, the colour of emitted light might be set to a first colour (e.g. red) as a first output signal, and might be set to a second colour (e.g. blue) as a second output signal. The lighting means may comprise an LED.

Where the output means 130 comprises a sound generator, the sound generator may be arranged to provide an output signal 180 through changing the volume, pitch or both of the generated sound. The output signal 180 may be the presence (or absence) of sound from the sound generator. As an example, the sound generator may emit a sound as a first output signal and no sound as a second output signal. Alternatively or additionally, more subtle variations in the volume, pitch or both of the sound may be used to provide two or more output signals. As an example, as a first output signal the sound generator may emit a sound at a first pitch and as a second output signal may emit a sound at a second pitch.

Where the output means 130 comprises a wireless signal transmitter, the wireless signal transmitter may be arranged to provide an output signal 180 by emitting a wireless signal. The output signal 180 may be conveyed by the presence (or absence) of a wireless signal from the wireless signal transmitter. As an example, the wireless signal transmitter may transmit a wireless signal as a first output signal and no wireless signal as a second output signal. Alternatively or additionally, the wireless signal transmitter may be arranged to convey data via the wireless signal. As an example, the wireless signal transmitter may be arranged to encode data representing a sensed environmental parameter provided as an input signal by the input means 120 of the integrated electronic device 100 onto a wireless signal.

The digital processing means 140 are arranged to process the input signal from the input means 120 and deliver (or generate) a command signal to the output means 130 based at least in part on the input signal. The command signal that is provided to the output means 130 causes the output means 130 to generate an output signal (or indication) 180 which is based on the command signal. The command signal that is generated by the digital processing means 140 may be based, at least in part, on the input signal. Where the input signal is representative of a sensed environmental parameter, the digital processing means 140 may generate a command signal which causes the output means 130 to provide an output signal 180 which is representative of the magnitude of the sensed environmental parameter. As an example, where the output means 130 comprises a display, the command signal may cause the display to display a numerical value indicating the magnitude of the sensed environmental parameter. For instance, if the input signal corresponds to a sensed environmental temperature of 37° C., the command signal might cause the display to display "37° C.". The digital processing means 140 may, however, perform additional processing on the input signal, for example, to apply thresholds to the input signal and display a corresponding output signal 180. The digital processing means 140 may determine whether the sensed value (e.g. temperature) lies above or below a certain threshold and may generate a command signal which causes the output means 130 to provide a corresponding output signal 180, such as causing lighting means to emit light if the temperature lies above or below the threshold (or vice-versa). Alternatively, the digital processing means 140 may determine whether the sensed value lies within a particular range and may generate a command signal which causes the output means 130 to provide a corresponding output signal 180. Multiple thresholds or ranges may be evaluated by the digital processing means 140, with the generated command signal causing the output means 130 to provide an output signal 180 indicating which threshold or range the sensed value lies within, such as causing lighting means to emit a different colour of light depending on the particular range or threshold which the sensed value lies within. As an example, if the input signal corresponds to a sensed environmental temperature, the digital processing means 140 may determine whether the sensed temperature falls within a given range of values (e.g. between 20° C. and 30° C.) or, if the value does not fall within the range, whether the value is below a threshold which is the lower end of the range (i.e. less than 20° C.) or above a threshold which is the higher end of the range (i.e. more than 30° C.). If, in this example, the sensed temperature does lie within the given range, the digital processing means 140 might generate a command signal which causes a display to display the text "OK" as an output signal 180, whereas, if the sensed temperature is lower or higher than the respective limits of the given range, the command signal generated by the digital processing means 140 might cause the display to display "TOO COLD" or "TOO HOT" respectively as an output signal 180.

The digital processing means may comprise a memory 190 and may, as part of its processing, store data derived from (or based on) the input signal in the memory 190. The command signal that is generated by the digital processing means 140 may be based, at least in part, on the stored data which is derived from one or more previous input signals. The processing performed by the digital processing means 140 may act to determine whether a particular condition has been triggered at any point during a proceeding period time, such as the preceding hour, week or indeed the lifetime of the integrated electronic device 100. The command signal that is generated by the digital processing means 140 may then cause the output means 130 to provide an appropriate indication of whether the condition has been triggered during that time period. It will be appreciated that the data derived from the input signal that is stored in the memory 190 may take many forms depending on the subsequent processing that is required. As an example, where the input signal corresponds to a sensed environmental temperature, a value corresponding to each sensed environmental temperature may be stored in the memory 190. Alternatively, a flag may be set in the memory 190 to indicate whether the sensed environmental temperature has ever reached a given condition. Similarly, a counter may be kept in the memory 190 to indicate the number of times a given condition has been reached. It will be appreciated that any appropriate data which is derived from the input signal may be stored in the memory 190 to allow future processing by the digital processing means 140 to generate a command signal which is based, at least in part, on the previous input signals. As an example, where the input signal is a sensed environmental temperature, the memory 190 may store data representing the previous sensed temperature values. The digital processing means 140 may then determine, based on the data in the memory 190, whether the sensed temperature has ever exceeded a particular threshold value (e.g. greater than 30° C.) or has been outside of a particular range of values (e.g. between 20° C. and 30° C.). The digital processing means 140 may then generate a command signal which causes the output means 130, such as a red LED, to provide an output signal 180 indicating whether the condition has ever been triggered, such as causing the red LED to emit light if the condition has been triggered and not otherwise.

The memory 190 may also or alternatively store other data which is not directly derived from the input signals. The processing that is performed by the digital processing means 140 may also or alternatively be based on such other stored data. For example, the values of the particular thresholds or ranges discussed above (or indeed any other configuration type values) may be stored in the memory 190. Of course, such thresholds or ranges may be provided to the integrated electronic device by an appropriate external stimulus 170 which causes the input means 120 to generate an input signal representing the thresholds or ranges which may then be stored in the memory 190 by the digital processing means 140. In such a case, the input means 120 may be responsive to more than one type of external stimulus 170, to generate different input signals for both the control (or setup or configuration) values and values relating to a sensed environment parameter and the digital processing means 140 may carry out different processing on each type of input signal.

The integrated electronic device 100 may comprise a switch (not shown) in order to improve the energy efficiency of the device 100. The switch may be used to reduce the amount of processing that is performed by the digital processing means 140 when such processing is not needed. The switch may comprise an on-off switch which functions to toggle between a state in which the integrated electronic device 100 is powered (i.e. in which it is using electrical power from the power source 110) and a state in which the integrated electronic device is not powered (i.e. in which it is not using electrical power from the power source 110). The switch may comprise a push switch which causes the integrated electronic device 100 to produce an output signal 180 when it is pushed. The integrated electronic device 100 need not therefore continually produce the output signal 180, thereby reducing its power requirements. Similarly, if the digital processing means 100 is only required to perform processing in order to cause an output signal 180 to be produced, or can perform less processing if an output signal 180 is not required, then further reductions in power requirements can be achieved by only performing the processing required to cause the output signal 190 to be produced when the push switch is pressed.

Figure 5:
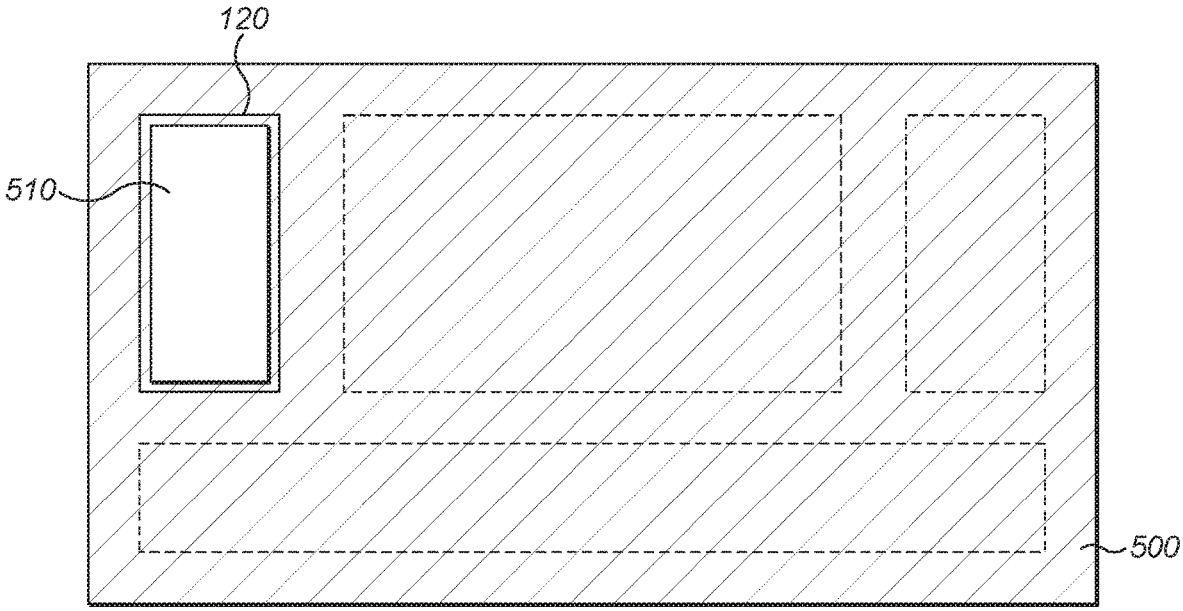
FIG. 5 schematically illustrates a further alternative electronic device for use in a product for holding a tobacco material according to an embodiment of the invention.
Figure 6:
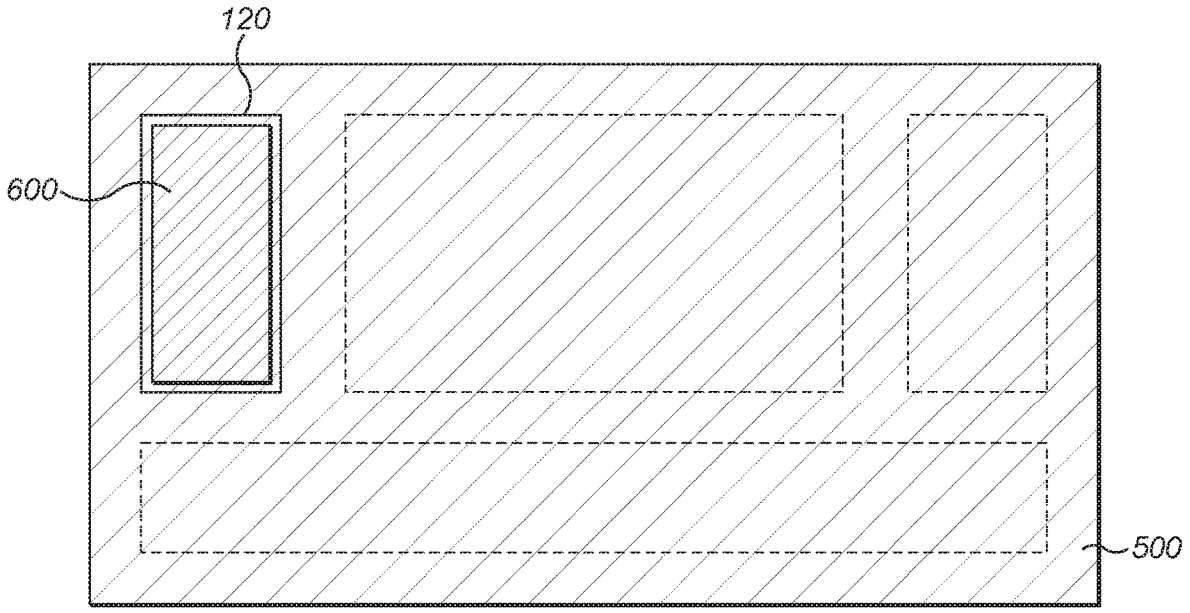
FIG. 6 schematically illustrates a further alternative electronic device for use in a product for holding a tobacco material according to an embodiment of the invention.
Figure 7:
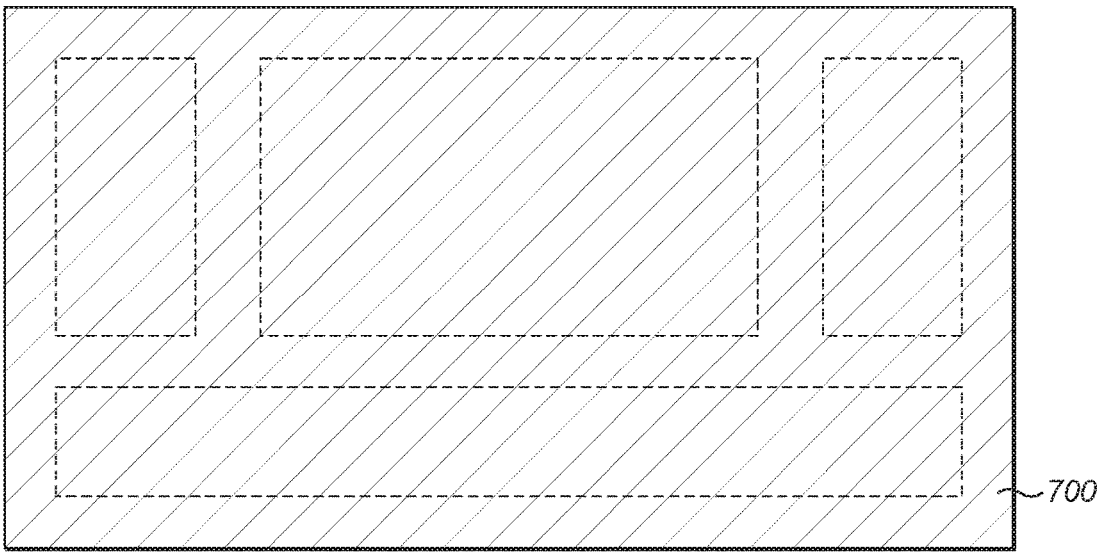
FIG. 7 schematically illustrates a further alternative electronic device for use in a product for holding a tobacco material according to an embodiment of the invention.

A protective layer (not shown) may be used to cover the integrated electronic device 100, helping to protect the various components of the integrated electronic device 100 from adverse environmental effects, thereby improving the lifespan and reliability of the integrated electronic device 100. The protective layer may be removable (as shown in FIG. 7), such that it may be removed when it is desired to start using the integrated electronic device 100. The removable protective layer may therefore cover the entirety (or all) of the substrate 160, the power source 110, the output means 130, the digital processing means 140, the circuitry 150 and the input means 120, helping to protect each of these components from the environment whilst the integrated electronic device 100 is being stored prior to use. The protective layer may be fixed (i.e. not removable), such that the integrated electronic device 100 may be used with protective layer in place. As shown in FIG. 5, the fixed protective layer may therefore cover the entirety (or all) of the substrate 160, the power source 110, the output means 130, the digital processing means 140 and the circuitry 150 apart from the input means 120. Of course, the protective layer may be a combination of removable and fixed comprising a portion of the protective layer which may be removed from the integrated electronic device 100 and a portion which is fixed. Such a protective layer might, for example, have a removable portion 600 which covers the input means 120 (as shown in FIG. 6) which can be removed prior to use of the integrated electronic device 100 leaving the fixed portion covering the remaining components of the integrated electronic device 100 while the device 100 is in use.

The integrated electronic device 100 as described above has many benefits stemming from the fact that the components are printed and that the substrate 160 is substantially flexible. These properties make the integrated electronic device 100 suited for application in a range of fields. One particular field in which the integrated electronic device 100 may be used is in the field of product packaging, particularly that of product packaging for tobacco products or tobacco substitutes. Many products, including tobacco products, have storage requirements that must be met in order for the product to remain in optimum condition or to ensure an optimum lifespan. Deviation from these storage requirements may result in degradation of the product. However, the logistics involved in the delivery of goods from point of manufacture or packaging to the end consumer is typically very complex meaning that it is hard to ensure or monitor whether the storage requirements for a particular product have been maintained throughout the supply chain. Furthermore, even after the product has been supplied to the end user, it may be desirable to continue monitoring the storage conditions of the product to allow the end user to periodically check whether the product is still in an optimal condition or whether it is likely to have degraded or expired due to the environment in which it has been stored. Additionally, even where the storage environment of a packaged product can be monitored, it is typically only practical to do so on a macro scale. In other words, only the overall environment of the storage room or warehouse that the packaged products are stored in is monitored. Due to variations within the storage room or warehouse, which may for example have localised hot or humid areas which are more hot or humid than elsewhere in the storage area, the actual environmental conditions that are experienced by each individual packaged product may differ. The properties of the integrated electronic device 100 as described above allow the integrated electronic device to be integrated into, or supplied with, the product packaging of each product, allowing the storage environment for each product to be monitored and reported on at all points through the supply chain and through the product's subsequent storage by the end user. In particular, the use of the invention is contemplated in respect of a container for storing tobacco. One of the common forms in which tobacco products are supplied to end users is in a loose form which allows the end user to create their own smoking article (e.g. "roll your own cigarettes"). This loose form tobacco is typically supplied in large containers which contain enough tobacco to allow for a relatively long period of use. Moisture in the atmosphere to which the tobacco is exposed is likely to cause the tobacco product to degrade. It is therefore desirable to allow the user to monitor the storage conditions of the tobacco product to allow them to rectify any incorrect storage of the tobacco product and/or assess whether the quality of the tobacco is likely to still be at an acceptable (or optimal) level. Whilst the following description is focussed on the use of an exemplary integrated electronic device 100 to be used with a tobacco container for storing loose tobacco to monitor the exposure of the tobacco to atmospheric moisture, it will be appreciated that such an integrated electronic device 100 may be used with any kind of container for any kind of product to monitor exposure of the product to atmospheric moisture. Similarly, it will be appreciated that the integrated electronic device 100 may be adapted to monitor exposure of product to other kinds of conditions such as temperature or sunlight. Furthermore, there are many other fields in addition to that of product packaging to which the integrated electronic device 100 may be applied.

Figure 2:
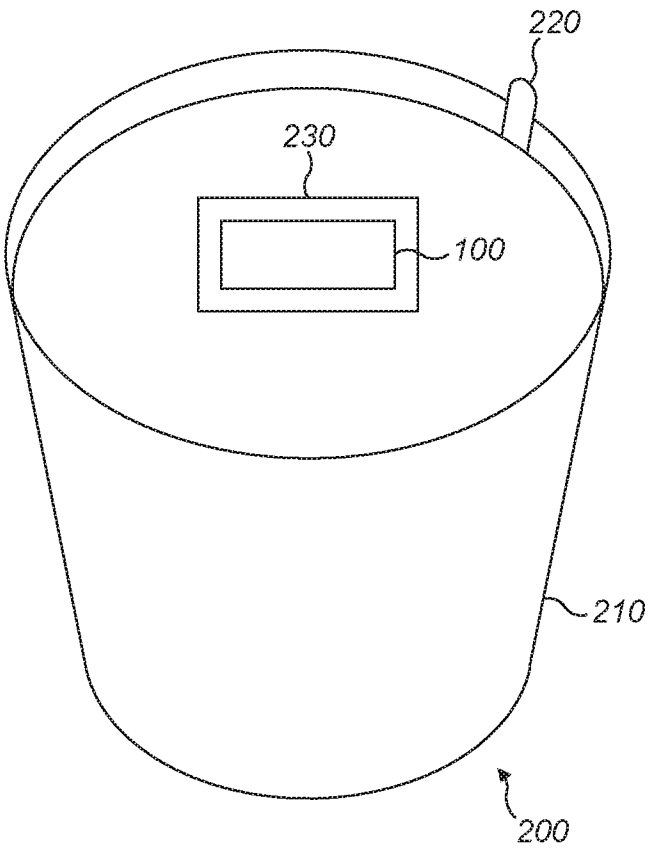
FIG. 2 schematically illustrates an exemplary package (or container) for storing tobacco.

FIG. 2 schematically illustrates an exemplary package (or container) 200 for storing tobacco. The package 200 comprises a body 210, a seal 220, a tag (or label or insert) 230 and optionally a lid (not shown).

The seal 220 is sealed to the body 210 as part of the manufacturing or packaging process in order to isolate the product inside the package, thereby preventing access to the product and helping provide protection against the environment until the seal 220 is removed. In order to access the product for the first time, the user must unseal (or break) the seal 220. It will be appreciated that whilst most packages will make use of a seal 220, it is not strictly necessary for the package to have a seal 220. As an example, a package might simply comprise a lid to protect or retain the product inside the packaging. Preferably the seal is made from aluminium foil.

The tag 230 comprises an integrated electronic device 100 for monitoring exposure to moisture or humidity in the immediate vicinity of the tag 230. Preferably the tag 230 is made of plastic such as PET which may also form the substrate 160 upon which the integrated electronic device 100 is formed. Preferably, the tag 230 is approximately the size of a typical credit card, that is to say approximately 8.9 cm by 3.8 cm (or 3.5 inches by 1.5 inches), so as to allow easy manufacture, packaging and handling of the tag 230. However, the tag 230 may be any size provided it is large enough to accommodate the integrated electronic device 100. In use, the tag is placed within the tobacco stored in the body 210 of the package 200 enabling the integrated electronic device to measure the direct environment of the stored tobacco. The tag 230 may be provided with the package 200 already placed in the stored tobacco. In other words, the tag 230 may be placed in the tobacco during the manufacturing or packaging process, before the seal 220 is sealed to the container body 210. Alternatively, as illustrated, the tag 230 may be placed on top of the seal 220 underneath the lid, in which case the user may be required to place the tag in the stored tobacco once the seal is unsealed.

The power source 110 of the integrated electronic device 100 preferably comprises a battery capable of storing sufficient electrical energy to power the integrated electronic device 100 for approximately 1 year.

The input means 120 of the integrated electronic device 100 comprises a humidity sensor. The humidity sensor produces an input signal indicative of the relative humidity of the environment based on the external stimulus 170 of the moisture in the immediate environment of the humidity sensor. Preferably the humidity sensor has a range of approximately 12% relative humidity with a sensitivity of 1% relative humidity in either direction at room temperature.

The output means 130 of the integrated electronic device 100 preferably comprises a display through which a visual output signal 180 can be provided.

The digital processing means 140 of the integrated electronic device 100 are arranged to process the input signal from the humidity sensor and deliver a command signal to the display to cause the display to generate an output signal 180, as discussed earlier. The digital processing means 140 is arranged to generate a command signal which causes the display to provide a numeric indication of the value of the sensed relative humidity as a percentage. As described above, the digital processing means 140 of the integrated electronic device 100 may comprise a memory, in which the digital processing means 140 may store data based on previous input signals to allow the digital processing means 140 to determine whether the sensed relative humidity has ever exceeded a particular threshold. If the digital processing means 140 determine that the threshold level of relative humidity has previously been exceeded, then the digital process means 140 may generate a command signal which causes the display to indicate this condition to the users, for example by displaying the text "TOO HUMID".

The integrated electronic device 100 may comprise an on-off switch as discussed above. The integrated electronic device 100 may therefore be configured to be in a powered off state during manufacture or packaging, such that electrical power from the power source 110 is preserved. The integrated electronic device 100 may therefore require activating by toggling the on-off switch so that the integrated electronic device 100 is powered before the package environment can be monitored by the integrated electronic device 100. The activation of the integrated electronic device 100 may take place during the manufacturing or packaging process, for example, the tag 230 may be placed in stored tobacco and the integrated electronic device 100 activated prior to the seal 220 being sealed. In this case, the environmental conditions throughout the supply chain may be monitored and reported on. Alternatively, the activation of the tag 230 may be performed by the end user upon opening the product. As an example, the tag 230 may be placed on top of the seal 220 during packaging with the integrated electronic device 100 in an unpowered (or off) state. Upon opening the package 200 and unsealing the seal 220, the user may place the tag 230 in the tobacco and toggle the switch to cause the integrated electronic device 100 to be powered so that the package's storage environment during the user's custody of the package may be monitored and reported on. This allows the lifespan of the integrated electronic device 100 during the user's custody of the package 200 to be maximised. The output means 130 of the integrated electronic device 100 may be further configured to provide an additional output signal 180 to indicate whether the device has been activated or not. As an example, the output means 130 might comprise lighting means (or additional lighting means) which is configured to emit light if the device has been activated and not otherwise.

Figure 3:
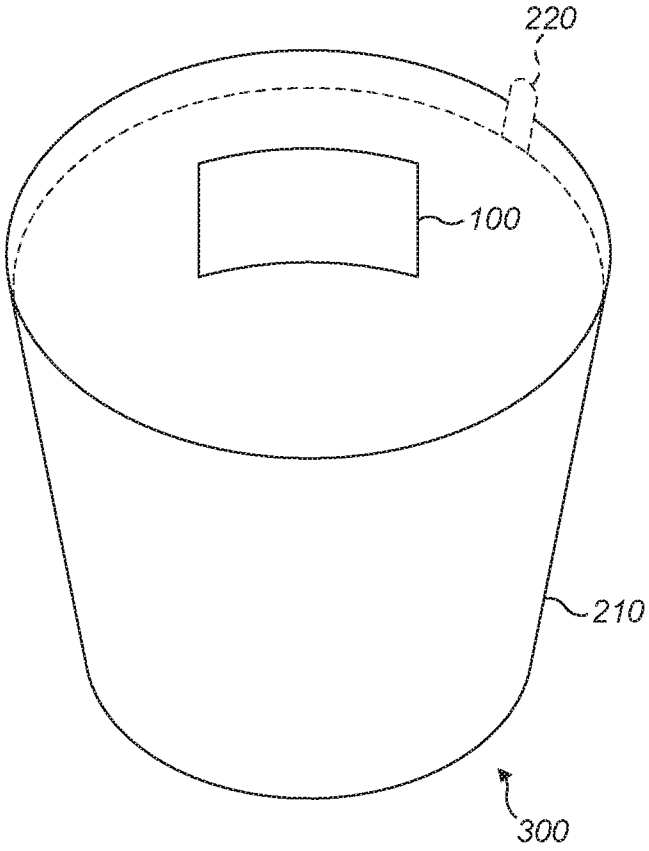
FIG. 3 schematically illustrates an alternative exemplary package (or container) for storing tobacco.

FIG. 3 schematically illustrates an alternative exemplary package (or container) 300 for storing tobacco. The exemplary package 300 illustrated in FIG. 3 is similar to the exemplary package 200 illustrated in FIG. 2. In a similar manner to the exemplary package 200 illustrated in FIG. 2, the exemplary package 300 illustrated in FIG. 3 comprises a body 210, a seal 220 and optionally a lid (not shown). However, instead of a separate tag upon which an integrated electronic device 100 has been formed, the integrated electronic device 100 of the exemplary package 300 illustrated in FIG. 3 has been formed as part of the wall of the body 210 of the package 300. The integrated electronic device 100 may be formed by printing its components directly on the material used to form the wall of the body 210 of the package 300 provided of course that the material from which the body wall is formed is appropriate for use as a substrate 160, such as plastic (e.g. PET). Where the material from which the body wall is formed is not appropriate for use substrate 160 a portion (or region) of the body wall upon which the integrated electronic device 100 is to be formed may be laminated with a material which is appropriate for use as substrate 160. Alternatively, the integrated electronic device may be formed on a separate piece of material in a similar manner to that used to produce the tag of the exemplary package 200 illustrated in FIG. 2, which may then subsequently be adhered to the wall of the body 210 of the package using a suitable adhesive. The integrated electronic device 100 is arranged as for the exemplary package 200 illustrated in FIG. 2, as discussed above. It will be noted that instead of forming the integrated electronic device 100 integrally with the wall of the body 210 of the package 300, the integrated electronic device 100 could instead be integrally formed with the lid of the package 300 or as part of the seal 220.

Through the provision of the integrated electronic device 100 as part of a product package for storing tobacco, users can assess the freshness and quality of the tobacco, as well as being able to determine whether the package has been stored in conditions which are outside of preconfigured humidity conditions.

The invention claimed is:

1. A container for holding a tobacco product or a tobacco substitute, comprising:

a sidewall defining a cavity;

a seal attached the sidewall to seal the cavity from an outside environment; and a tag detachably coupled to the container, the tag comprising:

an integrated electronic device including:

a power source;

an input comprising a sensor to generate an input signal from an environmental stimulus, the sensor comprising at least one of a humidity sensor, a light sensor, a temperature sensor and/or a gas sensor;

an output to generate an output signal, the output comprising at least one of a display, a light, a sound generator and/or a wireless signal emitter;

a digital processor to process the input signal and deliver a command signal to the output based at least in part on processing of the input signal; and circuitry connecting the power source, the input, the output and the digital processor, wherein the power source, the input, the output, the digital processor and the circuitry are printed on a substantially flexible substrate, and wherein the tag is moveable from an attached condition at which the tag is coupled to the container to an unattached condition at which the tag is disposed within the cavity after the seal has been removed.

2. The container according to claim 1, wherein the digital processor comprises printed dopant poly-silicon transistors.

3. The container according to claim 1, wherein the digital processor comprises a memory.

4. The container according to claim 1, wherein the input further comprises a wireless signal receiver.

5. The container according to claim 1, wherein the power source comprises at least one of a battery, an energy harvesting device and an electromagnetic charging device.

6. The container according to claim 1, wherein the substrate comprises synthetic and/or natural material in a sheet form.

7. The container according to claim 6, wherein the substrate comprises a laminate.

8. The container according to claim 6, wherein the substrate comprises folding and/or creasing lines.

9. The container according to claim 1, further comprising a protective layer covering all of the substrate, the power source, the output, the digital processor and the circuitry.

10. The container according to claim 9, wherein the protective layer further comprises a removable portion covering the input.

11. The container according to claim 1, further comprising a removable protective layer covering all of the substrate, the power source, the output, the digital processor, the circuitry and the input.

12. The container according to claim 1, further comprising a tobacco product or a tobacco substitute disposed within the cavity.

13. A contained for holding a tobacco product or a tobacco substitute, comprising:

a sidewall defining a cavity;

a loose tobacco product or a loose tobacco substitute disposed within the cavity;

a seal attached the sidewall to seal the cavity from an outside environment; and a tag disposed within the cavity and sealed from the outside environment, the tag including an integrated electronic device comprising:

a power source;

a sensor to generate an input signal from an external stimulus, the sensor comprising at least one of a humidity sensor, a light sensor, a temperature sensor and/or a gas sensor;

an output to generate an output signal, wherein the output is at least one of a display, a light, a sound generator and/or a wireless signal emitter;

transistors to process the input signal and deliver a command signal to the output based at least in part on processing of the input signal; and circuitry connecting the power source, the sensor, the output and the transistors, wherein the power source, the sensor, the output, the transistors and the circuitry are printed on a substantially flexible substrate.

14. The container according to claim 13, wherein the flexible substrate forms at least a portion of the tag.

* * * * *